US006379084B1

(12) United States Patent
Kennedy et al.

(10) Patent No.: US 6,379,084 B1
(45) Date of Patent: Apr. 30, 2002

(54) MINE STOPPING

(75) Inventors: William R. Kennedy; John M. Kennedy, both of Taylorville, IL (US)

(73) Assignee: Jack Kennedy Metal Products and Buildings, Inc., Taylorville, IL (US)

( * ) Notice: Subject to any disclaimer, the term of this patent is extended or adjusted under 35 U.S.C. 154(b) by 0 days.

(21) Appl. No.: 09/464,808

(22) Filed: Dec. 17, 1999

(51) Int. Cl.[7] ..... E21F 1/14

(52) U.S. Cl. ..... 405/132; 454/169; 299/12; 248/354.4; 52/217

(58) Field of Search ..... 405/272, 273, 405/274, 288, 132, 133, 134, 192, 151; 454/168, 169; 299/11, 12; 248/351, 354.1, 354.4; 52/217

(56) References Cited

U.S. PATENT DOCUMENTS

| | | | | | |
|---|---|---|---|---|---|
| 251,698 | A | * | 1/1882 | Coats et al. | 405/282 |
| 617,163 | A | * | 1/1899 | Jacobs | 405/282 |
| 891,897 | A | * | 6/1908 | Astrom | 405/282 |
| 1,478,303 | A | | 12/1923 | Snyder | |
| 1,594,921 | A | | 8/1926 | Barnett | |
| 2,350,113 | A | * | 5/1944 | Hurley | 405/282 |
| 2,729,064 | A | | 1/1956 | Kennedy et al. | 61/45 |
| 3,186,177 | A | | 6/1965 | Kannenberg | 61/41 |
| 3,851,856 | A | * | 12/1974 | Berg | 405/282 |
| 3,937,026 | A | | 2/1976 | Krings | 61/41 |
| 3,969,852 | A | | 7/1976 | Krings | 52/155 |
| 3,972,272 | A | * | 8/1976 | Bagby | 454/169 |
| 4,054,033 | A | | 10/1977 | Pillosio | 61/41 |
| 4,345,857 | A | | 8/1982 | Krings | 405/282 |
| 4,547,094 | A | | 10/1985 | Kennedy et al. | 405/132 |
| 4,685,837 | A | | 8/1987 | Cicanese | 405/282 |
| 4,820,081 | A | | 4/1989 | Kennedy et al. | 405/132 |
| 4,911,577 | A | | 3/1990 | Kennedy et al. | 405/132 |
| 5,167,474 | A | * | 12/1992 | Kennedy et al. | 405/132 |
| 5,215,411 | A | * | 6/1993 | Seegmiller | 405/290 |
| 5,222,838 | A | * | 6/1993 | Kennedy et al. | 405/302 |
| 5,813,647 | A | * | 9/1998 | Chen | 248/354.1 |

* cited by examiner

*Primary Examiner*—David Bagnell
*Assistant Examiner*—Frederick L. Lagman
(74) *Attorney, Agent, or Firm*—Senniger, Powers, Leavitt & Roedel

(57) ABSTRACT

A stopping system for use in mines. The stopping system includes a king post truss for reinforcing the stopping panels against excessive deflection due to a pressure differential across the stopping panels. The truss has a variable length to accommodate convergence and divergence of the mine walls on which the truss is mounted.

56 Claims, 6 Drawing Sheets

MINE STOPPING

BACKGROUND OF THE INVENTION

This invention relates to a mine stopping using a reinforcing brace or truss to resist deflection of the stopping when there is a pressure differential on opposite sides of the stopping. The stopping comprises a plurality of metal panels in side-by-side relation to a least partially close a passage in a mine and can have a door and/or pressure relief structure mounted in the stopping.

Mine stoppings are widely used in mines to impede or stop the flow of air in mine passages. This invention involves a mine stopping of the general type shown in U.S. Pat. Nos. 4,547,094, 4,820,081 and 4,911,577 but includes reinforcement to reduce deflection caused by air pressure differential loading of the stopping. Many of the prior art stoppings were formed from a plurality of side-by-side telescoping panels that extended from floor to ceiling across the width of the mine passage. The panels were secured together and in place in the mine passage, typically adjacent to the entrance of a passage. The stopping was also sealed to the walls, roof and floor if desired.

Some mine passages can be quite large, e.g., 20 feet wide and 10 feet high and even as large as 60 feet wide and 35 feet high. Further, the pressure differential across a stopping can be large. The large pressure differential and/or the large size of the mine passages that a stopping closes can subject the stopping to large forces which causes the stopping to bend or deflect. To reduce this deflection, bracing across the stopping is needed. The bracing can also be used to secure the panels of the stopping together in side-by-side relation. However, current bracing has not been as strong, versatile and simple to use in a mine as one would prefer.

Stoppings can also be provided with one or more doors and/or pressure relief or control means. In stoppings that include one or more doors, some resistance to deflection has been accomplished by using floor to ceiling jacks at positions intermediate the side walls which shortened the span for the bracing reinforcement which helped reduce deflection.

Another of the problems with the use of stoppings in mines is that the mine walls tend to shift over time, generally moving closer together from the weight of the overburden. Likewise, the floor and ceiling move closer together over time. Thus, a requirement for a stopping is to be able to accommodate this change in passage size over time without detrimental effect on the stopping.

SUMMARY OF THE INVENTION

Among the several objects of this invention may be noted the provision of improved mine stoppings of the type using a brace for reinforcement against deflection under load; the provision of such a stopping structure that will be effective in at least partially blocking a mine passage from air flow and is easy to install and maintain without excessive attention; the provision of a reinforcing truss for mine stoppings that is versatile in use and easy to install and that will accommodate mine passage size changes without operator attendance; the provision of such a truss that has a variable length to accommodate different sizes of passages and changes in the size of the passage after installation; the provision of such a truss that provides adequate resistance to deflection under load and requires reduced material for construction; the provision of a stopping system that includes a door and a door frame that cooperate with an extensible reinforcing truss that is easy to install and maintain and effective in reducing deflection while eliminating the need for floor to ceiling jacks; and the provision of a reinforcing truss that can be used at a joint between two sets of stopping panels that are in end-to-end relation to reinforce the stopping against deflection and to join the sets of stopping panels in end-to-end relation.

One aspect of the present invention involves the provision of a high pressure stopping system for use in a mine to at least partially block a mine passage. The stopping system includes a plurality of stopping panels positioned side-by-side to form a stopping wall extending between opposite side walls of a mine passage. An elongate brace is provided on a low pressure side of the stopping wall for reinforcing the stopping wall against deflection. The brace includes a central beam and at least one slide member operatively associated with the central beam to provide relative movement therebetween whereby the brace has a variable length.

Another aspect of the present invention includes the provision of a truss for reinforcing a mine stopping system against deflection when under load. The stopping system includes a plurality of stopping panels secured together side-by-side to form a stopping wall for at least partially closing a mine passageway. The truss includes a compression chord that has opposite ends. The chord comprises a central beam having opposite ends and at least one slide member slidably mounted on the central beam adjacent one end thereof. The slide member is movable relative to the central beam for varying the length of the compression chord. A tension chord having opposite ends is secured to the central beam adjacent opposite ends of the central beam. A web extends between the central beam and the tension chord generally at the center of the truss.

The present invention is also directed to a stopping system for use in mines to form a stopping wall to at least partially block a mine passage having side walls. The stopping wall has a normally high pressure side and a normally low pressure side. The stopping system includes a plurality of stopping panels positioned adjacent one another and secured together in side-by-side relation to form a portion of the stopping wall. A door frame defines an opening through the stopping wall and the door frame includes a pair of spaced apart generally vertical columns secured to some of the stopping panels. The door frame also includes a generally horizontal lintel that extends between the columns and is secured to some of the stopping panels. The columns each have a lower end disposed for engagement with a floor of the mine passage at a position between side walls of the mine passage. Each column also has an upper end spaced from a roof of the mine passageway and positioned adjacent a respective end of the lintel and secured thereto. The columns and lintel cooperate to reinforce the wall against deflection under a pressure differential load. At least one door is movably mounted on at least one of the columns and is sized and shaped to at least substantially close the opening.

Another aspect of the present invention involves the provision of a mine stopping system that includes a brace. The brace includes an elongate central beam and at least one slide member operatively associated with the central beam to provide relative movement therebetween whereby the brace has a variable length. The brace is secured to and extends between mine walls of a mine passageway. The system comprises a first set of generally vertical lower stopping panels that are positioned side->bide and have upper and lower ends. A second set of generally vertical upper stopping panels are positioned side-by-side and have upper and lower ends. The upper stopping panels are positioned above the lower stopping panels with the lower ends of the upper panels being positioned adjacent the upper ends of the lower stopping panels. The first and second sets of panels are positioned in the mine passageway and at least partially close the mine passageway. Means is provided for securing the central beam to selected upper and lower stopping panels adjacent the lower ends of the upper panels and the upper ends of the lower panels.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
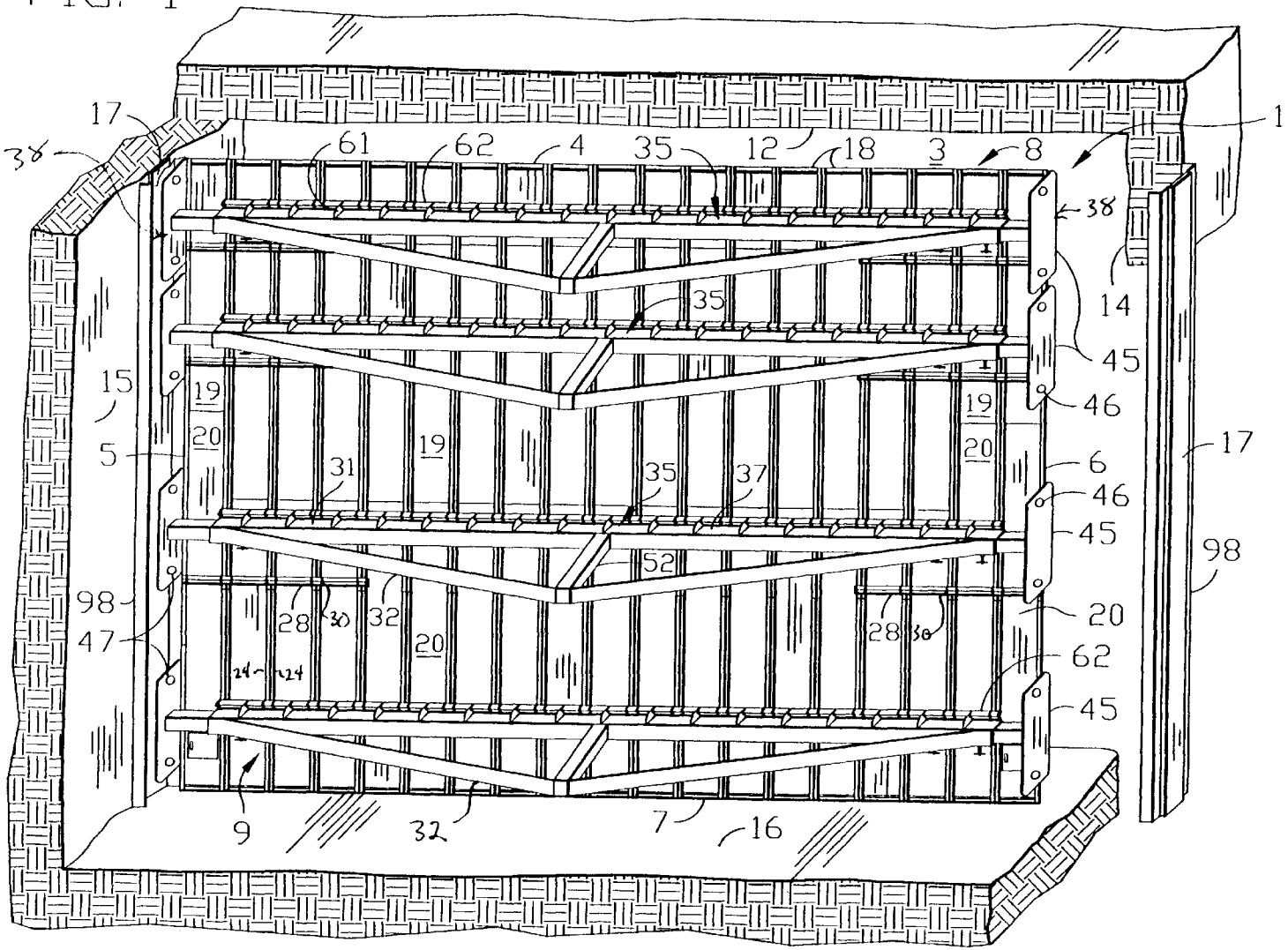
FIG. 1 is a fragmentary perspective view of a mine stopping in a mine with the stopping having a plurality of reinforcing trusses secured thereto with one side channel shown exploded.

Referring to FIG. 1, the numeral 1 generally designates a high pressure stopping system adapted for use in mines to at least partially close a mine passage 3. The system can be used to substantially or partially seal the passage against air flow therethrough. In the form of the invention shown in FIG. 1, the stopping system 1 is used to substantially seal against air flow creating a pressure differential across the stopping system 1 with a normally high pressure side 8 and a normally low pressure side 9. This pressure differential applies force to the stopping system 1 in the direction of the higher pressure side 8 toward the lower pressure side 9. In operation, it is to be understood that the high pressure side 8 and the low pressure side 9 may switch under certain circumstances but are normally in one orientation. Sealing can be accomplished by having the top edge 4, side edges 5, 6 and bottom edge 7 positioned adjacent to the top or ceiling 12, side walls 14, 15 and the floor 16 respectively and having suitable sealing material 17 (e.g., polymeric foam such as polyurethane and polystyrene) therebetween.

Figure 9:
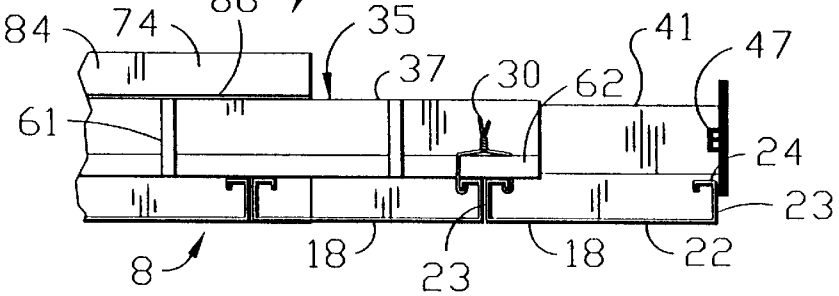
FIG. 9 is an enlarged fragmentary sectional view of the stopping system taken along the line 9—9 of FIG. 7.

The stopping system 1, in the form of the invention shown, includes a plurality of stopping panels 18 positioned in side-by-side relation and extending vertically in the mine passage 3. The stopping panels 18 can be of any suitable style, e.g., each one can be fabricated as a single piece panel or as a pair of panel sections 19 and 20 (FIG. 1) which are preferably channel shaped (FIG. 9) in transverse cross section. The panel sections 19 and 20 are slidably or telescopically connected, i.e. one fits within the other and can move coaxially relative to one another to form a telescoping stopping panel 18 as exemplified in U.S. Pat. Nos. 4,547,094, 4,820,081 and 4,911,577. As best seen in FIG. 9, the panel sections 19, 20 have a channel shaped transverse cross section with a panel web portion 22, opposing flanges 23 and inturned legs 24. The panel sections 19 and 20 are preferably of the same shape with one being smaller than the other so the smaller one will fit within the larger one for connection and telescoping movement. Preferably, the panels 19, 20 are metal, preferably steel.

When the panels 18 are installed in a mine, they are positioned in side-by-side relation and are extended in length to provide the desired height. The panels 18 are suitably secured in place in the mine passage 3 in the side-by-side relation. Such securement can be by any suitable means and helps prevent substantial relative movement between adjacent side-by side panels 18. As best seen in FIG. 1, rib angles or bars 28 are placed against the legs 24 of the panels 19, 20 and are secured thereto as for example by twist wires 30 or any other suitable means.

Figure 2:
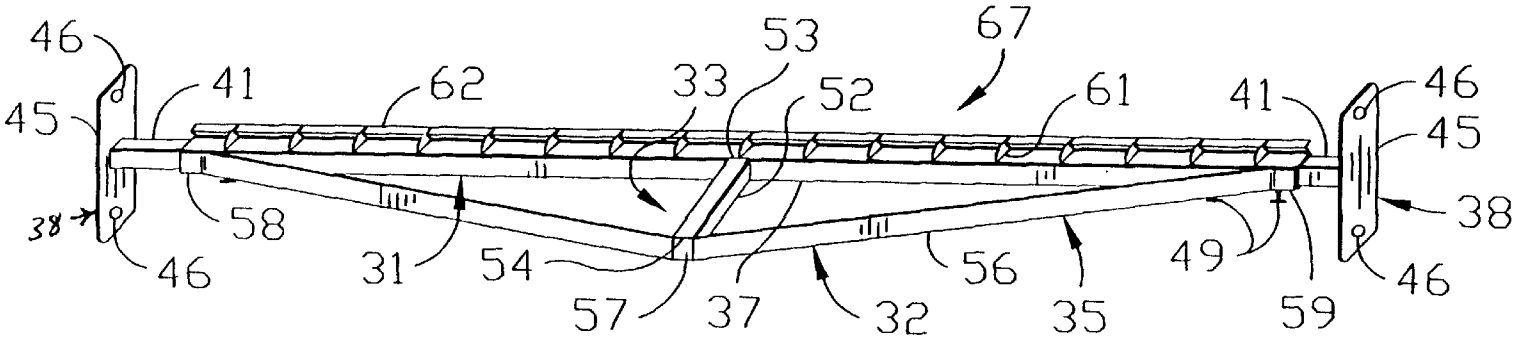
FIG. 2 is a perspective view of a reinforcing truss.
Figure 3:
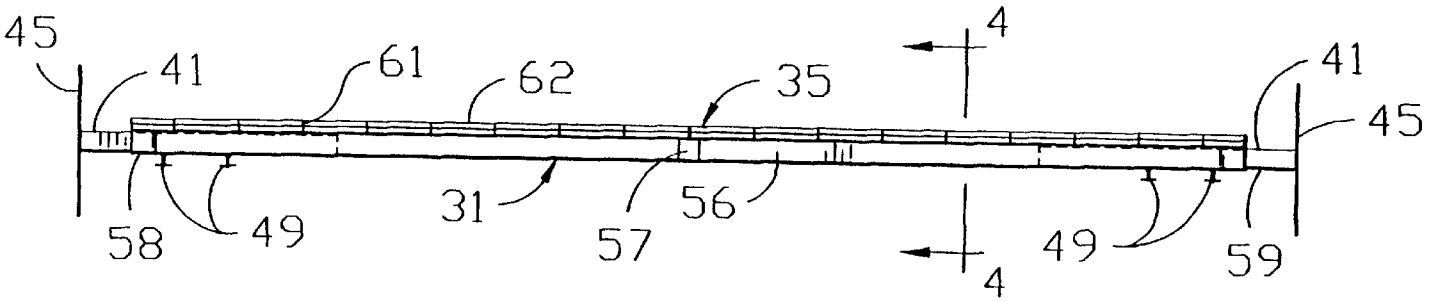
FIG. 3 is side elevation view of a reinforcing truss.

Referring now to FIGS. 1 and 2, the stopping system 1 includes one or more horizontal reinforcing braces or trusses 35 which are extensible or variable in length. Preferably each truss 35 includes a compression chord designated generally 31, a tension chord designated generally 32 and a web designated generally 33. The web 33 extends between the compression chord 31 and the tension chord 32. When more than one truss 35 is used in a stopping system 1, the horizontal trusses are spaced apart vertically and are preferably generally parallel. Anchor means 38 is also provided for mounting or securing the truss 35 to the mine wall.

The compression chord 31 is generally straight and has a variable length. The compression chord 31 has at least one central support member or beam 37 and as shown, there is one central beam 37. Length adjustment or variation is provided by having at least one slide member 41 mounted on the central beam 37 for telescoping movement. As shown, the central beam 37 is tubular having a rectangular transverse cross section with inside dimensions. The slide member 41 has a corresponding rectangular transverse cross section with outside dimensions slightly smaller than the inside dimensions of the central beam 37 and is slidably received therein for telescoping movement. It is to be understood that the cross sectional shape of the central beam 37 can vary and preferably corresponds generally to the cross sectional shape of the slide member 41 received therein. Preferably a slide member 41 is mounted in each of opposite ends of the central beam 37 permitting length adjustment or variation of the compression chord 31 at both ends of the central beam 37. The illustrated structure show the use of two slide members 41 in a truss 35, however, only one can be used on a truss. The length of the slide members 41 should be such that they will accommodate the maximum amount of mine wall divergence without disengaging from the central beam 37. During cycles of mine wall convergence and divergence, the central beam 37 could work completely to one side of the mine passage. Thus, the slide member 41 on the opposite end of the central support member would need to be long enough to prevent disengagement from the central beam 37. Additionally, the slide members 41 need to be sufficiently engaged in the central beam 37 to provide the necessary strength for the truss 35 to support the anticipated loads on the truss 35.

The anchor means 38 is operable to retain the truss 35 in position in the mine when the mine walls converge and diverge and load is applied to the stopping 1. An anchor means 38 is affixed to a slide member 41 in a manner that will allow tension and compression to be applied to the slide member for movement out of and into the central beam 37 respectively and still maintain integrity of the attachment of the anchor means 38 to a slide member 41. The anchor means 38 is preferably operable to allow for or effect both expansion and contraction of the length of the truss 35 and maintain the truss 35 secured to the mine walls. The anchor means 38 is secured to a mine wall to prevent movement of the truss 35 relative to or along the mine passage. As shown, the anchor means 38 includes a plate 45 connected or secured to an exteriorly positioned free end of each of the slide members 41. The plate 45 lies in a plane that is generally perpendicular to the longitudinal axis of the respective slide member 41. The plate 45 has apertures 46 for receiving appropriate fasteners 47 such as anchor bolts that are anchored into the side walls 5, 6. Other forms of anchor means 38 could be used. For example, the anchor means 38 can be brackets or the like, separate from the truss 35, that are secured to the mine walls. Further by way of example, the plate member 45 could have a clevis type mount (not shown) secured thereto and be separate from the slide member 41. The corresponding slide member 41 would have a through bore for receiving a pin. Such a plate 45 would be secured to the mine wall. One end of the truss would then be lifted into place and a pin (not shown) placed through the clevis and the through bore to pivotally mount one end of the truss 35 in place. The other end would then be lifted with a jack or the like and secured in place with an anchor plate 45 secured to the slide member 4 as described above. This type mount could simplify installation where a lifting device capable of lifting the truss in its entirety is not available.

Retaining means is also provided to restrict telescoping movement of the slide members 41 in the central beam 37. As shown, the retaining means is preferably friction lock means including T-handled set screws 49 that are threadably mounted in the central support member 37. When the set screws 49 are tightened, they will engage respective slide members 41 and frictionally retain the slide members 41 in their initial adjusted position or a subsequent position due to wall movement. The friction between the set screws 49 and the slide members 41 resists relative telescoping of the central beam 37 and slide members 41. However, convergence or divergence of the side walls overcomes the frictional force causing telescoping movement of the slide members 47 relative to the central beam 37. Such telescoping movement does not inelastically deform the central support member 37 or the slide members 41 and does not alter their structural integrity. Because the engagement is frictional, should the mine walls move after installation of the truss 35, the slides 41 will still be able to move in either an extension or contraction direction relative to the central beam 37. This relative movement prevents excessive axial loading of the central beam 37 and the slide members 41.

In a preferred form of the truss 35, the truss is in the form of a king post truss. As shown in FIG. 2, the web 33 includes a compression member such as a king post 52, having opposite ends 53 and 54. The king post 52 is mounted generally centrally of the central beam 37. It has one end 53 adjacent to and suitably secured to the central beam 37 adjacent the center thereof such as by welding. The king post 52, as shown, has a generally rectangular transverse cross section and can be tubular. The other end 54 is positioned a distance from the central beam 37. The king post 52 can be generally perpendicular to the central beam 37.

The tension chord 32 is a tension or brace member that has opposite end portions 58, 59 and a center portion 57. The end portions 58, 59 are positioned adjacent opposite ends of the central beam 37 and are suitably secured thereto, as by welding. The end 54 of the king post 52 engages the center portion 57 and is preferably suitably secured thereto, as by welding. The tension chord 32 can be made from a flat metal strap and, when the truss 35 is in use, normal loading thereof will put the tension chord 32 in tension allowing for the use of a simple transverse cross section.

When the truss 35 is loaded from the pressure differential, the loading force is directed from the front side 67 of the central beam 37 toward the end 54 placing the tension chord 32 in tension and the king post 52 in compression.

Figure 4:
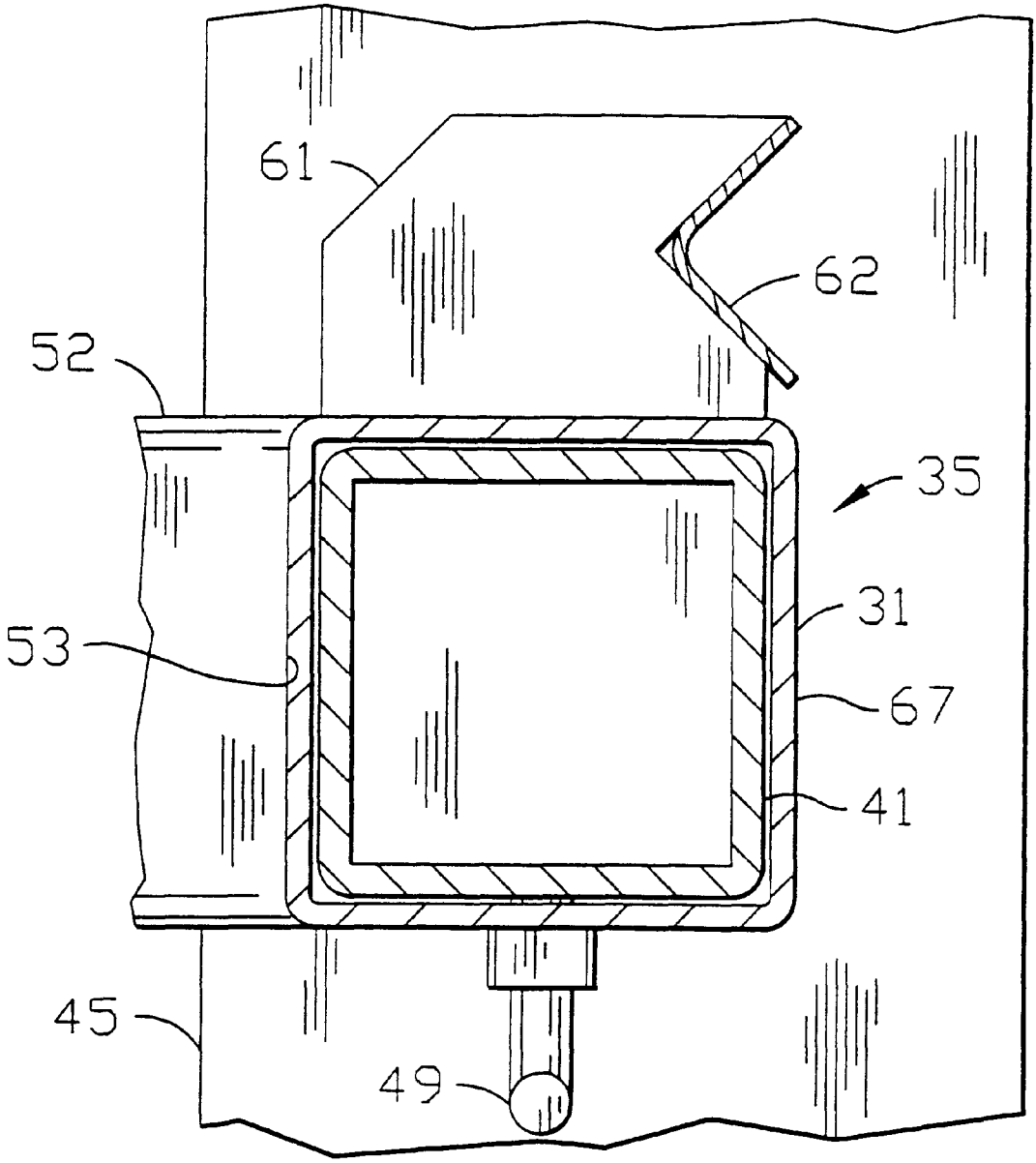
FIG. 4 is sectional view of the reinforcing truss taken alone the line 4—4 of FIG. 3.

The truss 35 is provided with suitable securement means that is affixed to the central beam 37 for attaching or securing the truss 35 to the stopping panels 18. As best seen in FIG. 4, the securement means includes a plurality of uprights 61 (formed from metal plate, for example) suitably secured to the central beam 37 and spaced apart along the length thereof. An elongate panel securement member such as rib member 62, such as a metal angle, is suitably secured to the uprights 61 with the open side facing away from the truss 35 and toward the stopping panels 18. The rib member 62 is preferably a metal angle. Twist wires, clamps or other suitable means 30 can be used to secure the rib member 62 and hence the truss 35 to the stopping panels 18 (FIGS. 1, 8).

Figure 8:
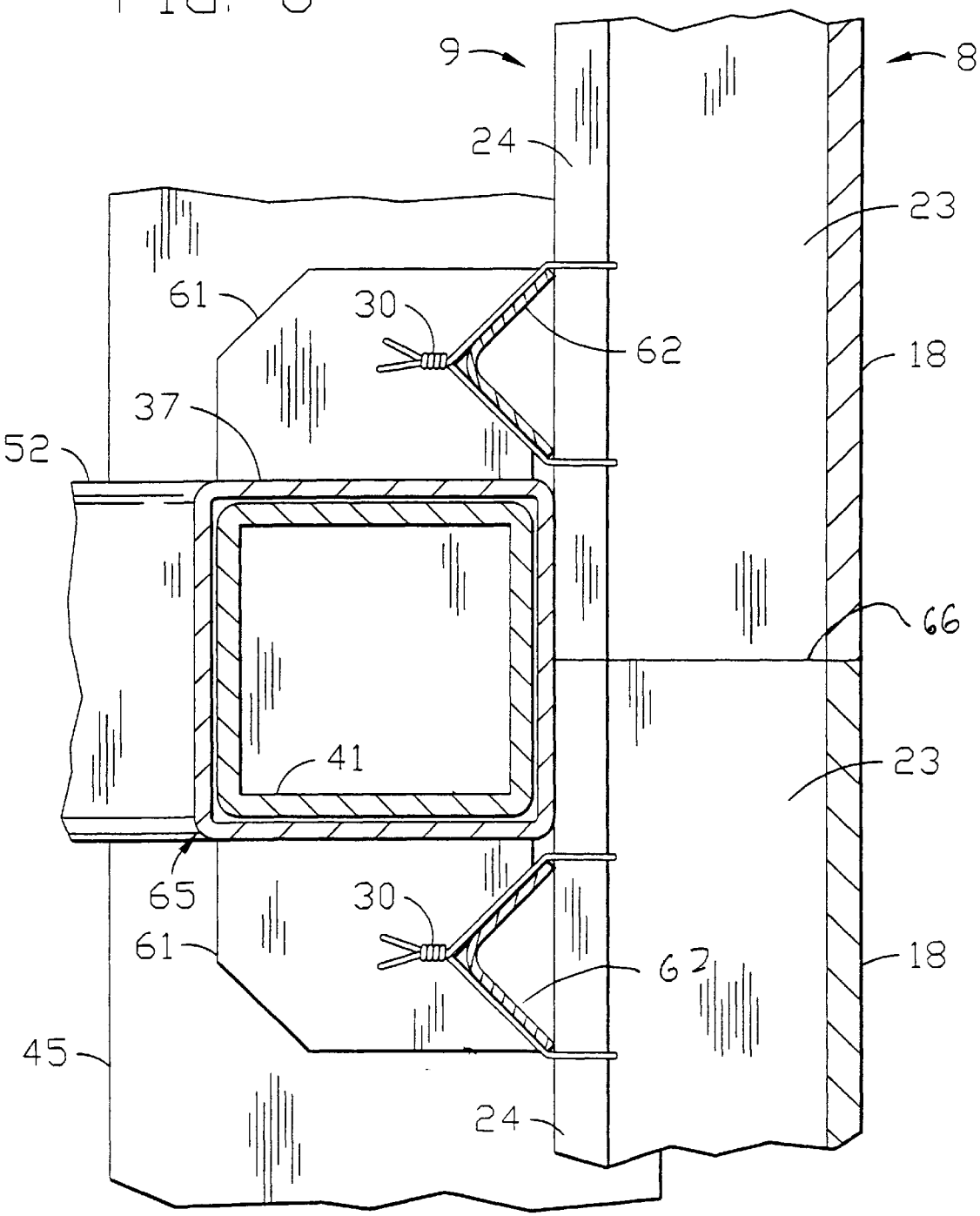
FIG. 8 is a enlarged fragmentary end sectional view of a modified form of the truss and stopping system.

A modified form of truss 35 and stopping system is provided and is best seen in FIG. 8. The modified truss is designated generally as 65. It is the same as the truss 35 except that it uses two securement members which are shown as upper and lower sets of uprights 61 and rib members 62. The ribs 62 and sets of uprights 61 are positioned on opposite sides of the central beam 37 whereby the two rib members 62 are spaced apart in positions above and below the central beam 37. In this embodiment, the truss 65 can be used at a joint between two sets of stopping panels 18 to secure them in end-to-end abutting relation allowing the use of shorter stopping panels 18. For example, two ten (10) foot sets of stopping panels 18 can be used instead of one twenty (20) foot set of stopping panels 18. The joint 66 between the two sets of stopping panels 18 is located between the two rib members 62. The brace or truss 65 is secured to the stopping panels 18 as described above for the truss 35 with clamps or twist wires 30. If desired, one or more trusses 35 can be used along with the truss 65 on a stopping system 1 for additional reinforcement.

As seen in FIG. 1, the stopping system can utilize one or more trusses 35 secured thereto in a generally horizontal orientation. The trusses 35 are secured to the stopping panels 18 on the normally low pressure side of the stopping system to reduce bending or deformation of the stopping system. Such mounting and loading places the tension chord 32 in tension. The generally V-shape of the truss 35 and tension chord 32 results in a smaller quantity of material being needed to provide the required strength. Also, the general V-shape of the truss 35 results in the truss having a higher or larger moment of inertia at the center of the truss 35 than at its opposite ends. Further, in the V-shape form of truss 35, the moment of inertia continuously increases from adjacent each end of the truss toward the central area of the truss 35 where it is at a maximum.

A modified form of the invention is shown in FIGS. 5, 6, 7 and 9. In this form, a stopping system 71 is provided with a selectively openable door 70 that will allow passage of personnel or equipment thru the stopping system and/or the controlled passage of air therethrough.

The stopping system 71 includes a door frame means 72 comprising spaced apart generally vertical columns 73 and a header or lintel 74 spaced from the floor 16 and ceiling 12 and secured to upper ends 75 of the columns 73. The columns 73 can have feet 76 that are adapted to be suitably secured to the floor 16 by fasteners 77 to prevent movement of the columns on the floor 16 and along the mine passage. The columns 73 preferably have a height less than the height of the ceiling. The columns 73 can have any suitable transverse cross section and preferably are tubular with a generally rectangular transverse cross section.

Figure 7:
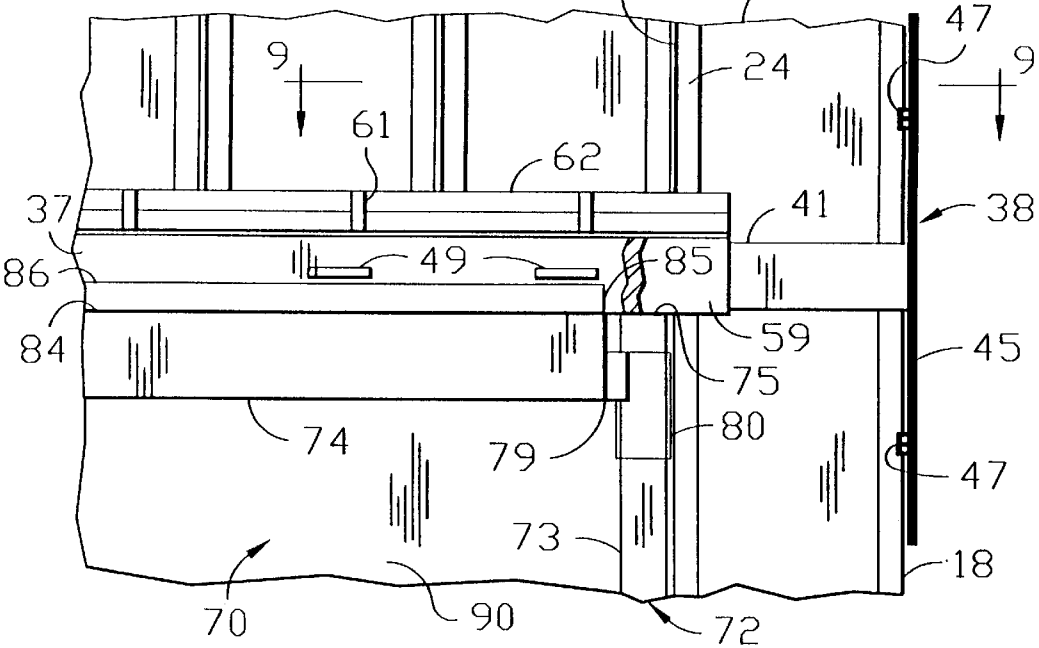
FIG. 7 is an enlarged fragmentary view of the lintel and column shown in FIG. 5.

The lintel 74 is suitably secured to the columns 73 adjacent their upper ends 75. As shown in FIG. 7, the lintel has brackets 79 secured to opposite ends of the lintel 74, e.g., by welding. The brackets 79 are in turn suitably secured to sleeves 80 such as by welding. The sleeves 80 are tubular and are sized to slide over the columns 73 and to be adjustably secured in selected vertical position on the columns, e.g., by set screws 81. This mounting arrangement allows for adjustability of the components during installation. The lintel 74 can have any suitable transverse cross section and can be tubular with a generally rectangular transverse cross section. The lintel 74 has an upper disposed surface 84 with an upwardly opening channel member 85 secured (e.g., welded) thereto and extending along the length of the lintel 74. The channel member 85 is preferably generally U-shaped with two upstanding legs 86 defining an upwardly opening channel 87 (see FIG. 6).

Figure 5:
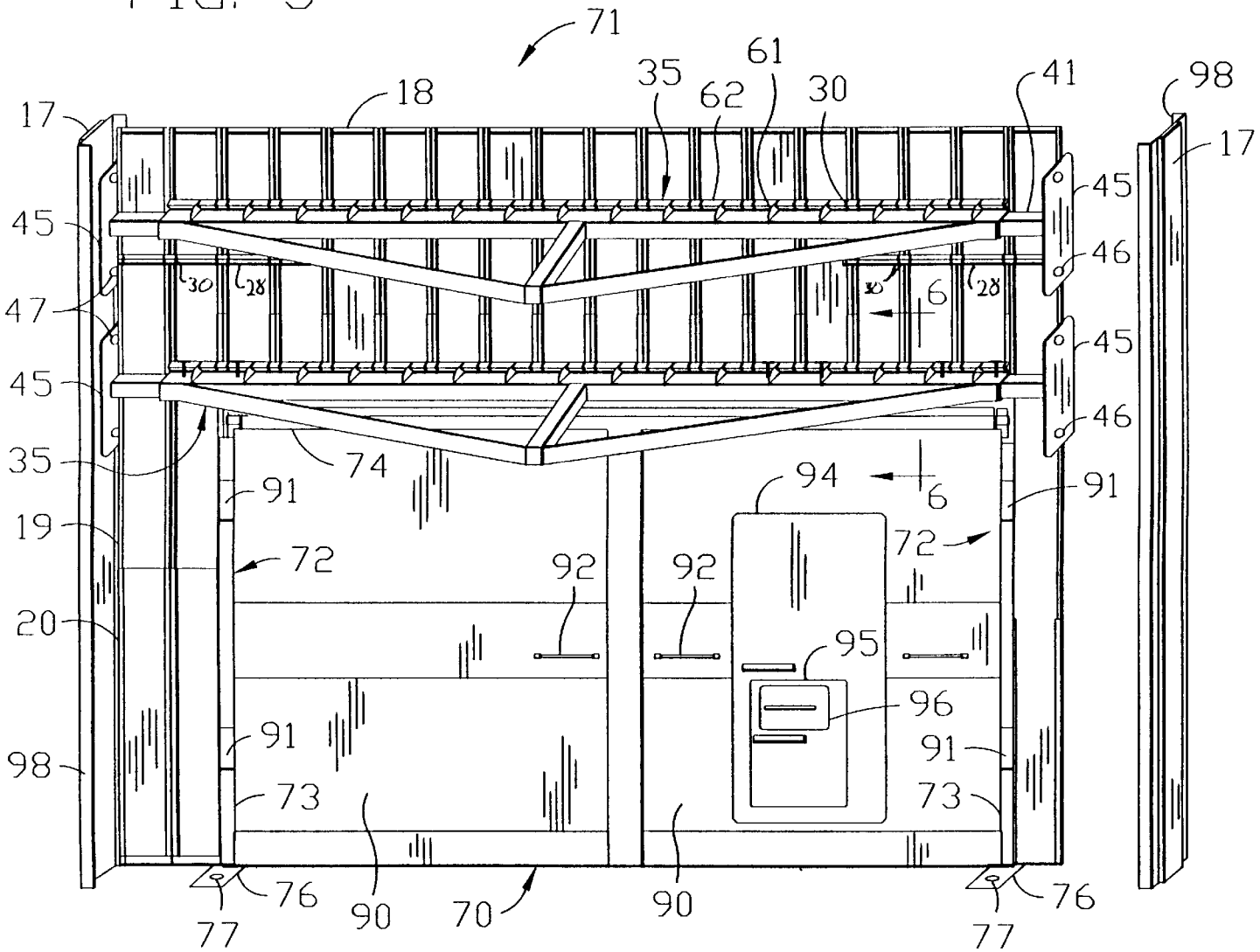
FIG. 5 is a perspective view of a stopping with a door unit with one side channel shown exploded.
Figure 6:
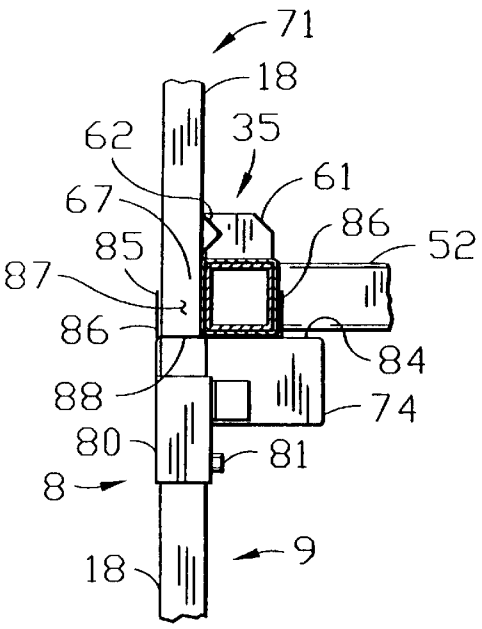
FIG. 6 is an enlarged fragmentary sectional view taken along the line 6—6 of FIG. 5 showing details of a support column and lintel.

The stopping system 71 includes stopping panels 18 positioned between the columns 73 and the side walls 14, 15 and secured in place as described above. Shorter stopping panels 18 are positioned above the lintel 74, extending upwardly therefrom. The shorter stopping panels 18 are positioned between the lintel 74 and the ceiling 12 and are suitably secured together with ribs 28 and twist wires 30. The lower disposed ends 88 of the stopping panels 18 above the lintel 74 are positioned in the channel 87 between the legs 86 to secure them against movement as described below. A truss 35 is also mounted or secured in the channel member 85 to reinforce the stopping system 71 in an area adjacent the lintel. The truss 35 reduces the amount of deflection or movement of the columns 73 and the lintel 74 during loading and thus eliminates the need for floor to ceiling columns. The central beam 37 of the truss 35 is placed in the channel 87 between the lower end portions 88 of the stopping panels and a leg 86 of the channel. The truss 35 and the stopping panels 18 above the lintel 74 are supported vertically by the lintel 74. The channel member 85 functions as a securement means associated with the truss 35 and the stopping panels 18 above the lintel 74 for tying the lintel to the central beam 37 and upper stopping panels 18 at a position adjacent to the lower ends 88 of the selected stopping panels. When the stopping system 71 deflects under load, the truss 35 is urged into frictional engagement with one leg 86 by the stopping panels 18 in the channel member 85. The channel member 85 thus secures or retains the selected stopping panels 18 above the lintel 74 and the truss 35 substantially immovable relative to one another. As shown in FIG. 5, one or more additional trusses 35 can be used on the stopping system 71.

The use of a lintel 74 and columns 73 changes the load distribution on the truss 35 relative to the form of the invention shown in FIG. 1 and should also help reduce deflection of the stopping system.

The door 70 can include one or more door panels or leaves 90 suitably movably mounted on the columns 73 as for example by hinges 91. The leaves 90 can be retained closed by a suitable latch 92. One of the leaves 90 can have a man door 94 movably mounted thereon. Alternatively, in the absence of a door 70, the man door 94 can be movably mounted in stopping panels 18 to provide a selectively openable passage for regulated flow of air thru the stopping system 71. As shown, varying amounts of air flow can be provided by having a series of different sized leaves 94, 95, 96 movably mounted on the stopping system 71 and their respective passages thru the stopping system 71.

As seen in FIGS. 1 and 5, a pair of vertical anchor channels 98 can be mounted on the side walls 14, 15, as with anchor bolts (not shown) and be positioned between the plates 45 and the respective side wall 14, 15. These channels provide smoother surfaces than the walls 14, 15 and thus a better side fit for the stopping panels 18. Seal material 17 can be used between the stopping system 1 or 71 and the ceiling 12, side walls 14, 15 and the floor 16 of the mine passage.

In a preferred embodiment, the stopping systems are constructed of metal, e.g., steel.

The embodiments of the invention disclosed above are illustrative. Many variations of the mine stopping I and truss 35 are possible without departing from the scope of the invention. For instance, the truss 35 may have other shapes than the general V-shape, e.g., generally rectangular. The cross sectional shapes of the components of the truss can also be different for example the tension chord 32 could be an angle member and the compression chord 31 and slide members 41 could be round. The mounting means 38 for the truss could be clevis type mounts instead of plates 45 secured to the slide members 41.

The trusses 35, 65 provide an advantage of being easy to install in a mine environment. They will also accommodate convergence and divergence of the mine and still be effective in supporting the stopping panels 18 against deflection from air pressure. The structure of the trusses allows them to self adjust to accommodate mine convergence and divergence reducing maintenance and costs. By having variable length, the trusses can be used in mine passages of various widths increasing the versatility of application thereby decreasing the number of different trusses needed for an inventory. The truss 65 further provides a simple means of joining together end-to-end stopping panels 18 while also providing resistance to deflection of the stopping system from pressure differentials on the stopping system.

When introducing elements of the present invention or the preferred embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A high pressure stopping system for use in a mine to at least partially block a mine passage, said stopping system comprising:

a plurality of stopping panels adapted to be positioned side-by-side to form a stopping wall extending between opposite side walls of a mine passage; and an elongate brace for reinforcing the stopping wall against deflection, said brace comprising a tubular central beam and at least one telescoping slide member telescopically engaging the central beam to provide relative movement therebetween whereby said brace has a variable length.

2. A stopping system as set forth in claim 1 further comprising anchor members at opposite ends of the brace adapted to be secured to respective side walls for securing said central beam and slide member against movement relative to the mine passage.

3. A stopping system as set forth claim 2 including means securing the brace to selected stopping panels of the stopping wall with said brace being generally horizontally disposed and extending between the side walls of the mine passage.

4. A stopping system as set forth in claim 2 wherein said anchor members are secured to the brace adjacent its said opposite ends.

5. A stopping system as set forth in claim 4 wherein said brace includes two slide members telescopingly mounted on opposite ends of the central beam, and friction lock means for locking the slide members in adjusted position with respect to the central beam, said friction lock means being adapted to permit telescoping of the slide members and the central beam relative to one another in the event of convergence of the mine walls.

6. A stopping system as set forth in claim 5 wherein said anchor members are secured to respective slide members.

7. A stopping system as set forth in claim 6 wherein each anchor member includes a plate connected to a respective slide member and lying in a plane generally perpendicular to a longitudinal axis of the slide member.

8. A stopping system as set forth in claim 6 wherein said brace is in the form of a truss in which said central beam and slide members comprise a compression chord of the truss, said brace further comprising a generally V-shaped tension chord connected to the compression chord adjacent opposite ends thereof and a web extending between the tension and compression chords.

9. A stopping system as set forth in claim 8 wherein the web includes a king post extending generally at right angles to the compression chord.

10. A stopping system as set forth in claim 9 wherein said tension chord is attached to the king post.

11. A truss for reinforcing a mine stopping system against deflection when under load, said stopping system comprising a plurality of stopping panels secured together side-by-side to form a stopping wall for at least partially closing a mine passageway, said truss comprising:

a compression chord having opposite ends and comprising a central beam having opposite ends and at least one slide member slidably mounted on said central beam adjacent one end thereof and being movable relative to the central beam for varying the length of the compression chord;

a tension chord having opposite ends secured to the central beam adjacent opposite ends of the central beam; and a web extending between the central beam and the tension chord generally at a center of the truss.

12. A truss as set forth in claim 11 wherein the truss has a larger moment of inertia generally at the center of the truss than at opposite ends of the truss.

13. A truss as set forth in claim 12 further comprising anchor members at opposite ends of the compression chord adapted to be secured to respective side walls for securing said central beam and slide member against movement relative to the mine passage.

14. A truss as set forth in claim 13 wherein said compression chord further comprises two slide members telescopingly mounted on opposite ends of the central beam, and friction lock means for locking the slide members in adjusted position with respect to the central beam, said friction lock means being adapted to permit telescoping of the slide members and the central beam relative to one another in the event of convergence of the mine walls.

15. A truss as set forth in claim 14 wherein said anchor members are secured to the compression chord adjacent its said opposite ends.

16. A truss as set forth in claim 15 wherein each anchor member includes a plate connected to a respective slide member and lying in a plane generally perpendicular to a longitudinal axis of the slide member.

17. A truss as set forth in claim 15 wherein said tension chord is generally V-shaped and said web extends between the tension and compression chords generally at the center of the truss.

18. A truss as set forth in claim 17 wherein the web includes a king post extending generally at right angles to the compression chord and secured to the compression chord and the tension chord.

19. A truss as set forth in claim 12 further comprising an elongate panel securement member affixed to the central beam and extending along a substantial portion of the length of the central beam for securing the central beam to said stopping panels.

20. A truss as set forth in claim 19 wherein the securement member includes a plurality of spaced apart uprights secured to the central beam and a rib member secured to the uprights with said rib member extending along at least a portion of the length of the central beam and being spaced from the central beam.

21. A truss as set forth in claim 20 comprising two securement members affixed to the central beam above and below the central beam.

22. A truss as set forth in claim 21 wherein each rib member comprises an angle bar.

23. A stopping system installed in a mine to form a stopping wall to at least partially block a mine passage having side walls, said stopping wall having a normally high pressure side and a normally low pressure side, said stopping system comprising:

a plurality of stopping panels positioned adjacent one another and secured together in side-by-side relation to form a portion of said stopping wall;

a door frame defining an opening through the stopping wall, said door frame including a pair of spaced apart generally vertical columns secured to some of the stopping panels and a generally horizontal lintel secured to some of the stopping panels and extending between said columns, said columns each having a lower end disposed for engagement with a floor of the mine passage at a position between side walls of the mine passage and an upper end spaced from a roof of the mine passageway and positioned adjacent a respective end of the lintel and secured thereto, said columns and lintel cooperating to reinforce the wall against deflection under a pressure differential load; and at least one door movably mounted on at least one of said columns.

24. A stopping system as set forth in claim 23 further including a brace for reinforcing said stopping wall against deflection, said brace having opposite ends and comprising at least one elongate central beam, at least one slide member operatively associated with the central beam to provide relative movement therebetween whereby said brace has a variable length, at least one anchor member at one end of the brace attachable to a mine wall for securing the brace against movement relative to the mine passage, and mounting means for mounting the brace in a position above the lintel adjacent to selected stopping panels and extending up from the lintel.

25. A stopping system as set forth in claim 24 wherein said mounting means includes an upwardly opening channel attached to the, lintel for receiving the central beam of the brace and lower end portions of said selected stopping panels.

26. A stopping system as set forth in claim 25 wherein said brace includes two slide members telescopingly mounted on opposite ends of the central beam and friction lock means for frictionally retaining said slide members in adjusted position with respect to the central beam, said friction lock means being adapted to permit telescoping of the slide members and the central relative to one another in the event of convergence of the mine side walls.

27. A stopping system as set forth in claim 26 wherein said anchor members are secured to the brace adjacent its said opposite ends.

28. A stopping system as set forth in claim 27 wherein each anchor member includes a plate connected to a respective slide member and lying in a plane generally perpendicular to a longitudinal axis of the slide member.

29. A stopping system as set forth in claim 28 wherein said brace is in the form of a truss in which said central beam and slide members comprise a compression chord of the truss, said brace further comprising a generally V-shaped tension chord connected to the compression chord adjacent opposite ends thereof and a web extending between the tension and compression chords.

30. A stopping system as set forth in claim 29 wherein the web includes a king post extending generally at right angles to the compression chord.

31. A mine stopping system installed in a mine comprising:

a brace comprising an elongate central beam, at least one slide member operatively associated with the central beam to provide relative movement therebetween whereby said brace has a variable length, and anchor members at opposite ends of the brace attached to mine walls of a mine passageway so that the brace is secured to and extends between said mine walls;

a first set of generally vertical lower stopping panels positioned side-by-side and having upper and lower ends;

a second set of generally vertical upper stopping panels positioned side-by-side and having upper and lower ends, the upper stopping panels being positioned above lower stopping panels with the lower ends of the upper panels positioned adjacent the upper ends of the lower stopping panels, the first and second sets of panels being positioned in said mine passageway and at least partially closing the mine passageway; and means for securing the beam to selected upper and lower stopping panels adjacent the lower ends of the upper panels and the upper ends of the lower panels, said at least one slide member being operatively associated with the central beam so that said at least one slide member may move relative to the central beam upon movement of at least one of said mine walls.

32. A mine stopping system as set forth in claim 31 wherein said brace includes a first and second elongate panel securement members affixed to the beam and extending along a substantial portion of the length of the beam.

33. A mine stopping system as set forth in claim 32 further including means cooperating with the panel securement members and the upper and lower stopping panels for securing the brace to the first and second stopping panels.

34. A mine stopping system as set forth in claim 33 wherein said securement members are positioned above and below the central beam.

35. A mine stopping system as set forth in claim 34 wherein each securement member comprises a plurality of spaced apart uprights secured to the beam and a rib member secured to the uprights with said rib member extending along at least a portion of the length of the beam and being spaced from the beam.

36. A mine stopping system as set forth in claim 34 wherein said brace is in the form of a truss in which said central beam and slide member comprise a compression chord of the truss, said brace further comprising a generally V-shaped tension chord connected to the compression chord adjacent opposite ends thereof and a web extending between the tension and compression chords.

37. A mine stopping system as set forth in claim 36 wherein the web includes a king post extending generally at right angles to the compression chord.

38. A mine stopping system as set forth in claim 37 wherein said tension chord is attached to the king post.

39. A mine stopping system as set forth in claim 38 wherein said brace includes two slide members telescopingly mounted on opposite ends of the central beam and said brace further including friction lock means for locking the slide members in adjusted position with respect to the central beam, said friction lock means being adapted to permit telescoping of the slide members and the central beam relative to one another in the event of convergence of the mine walls.

40. A mine stopping system as set forth in claim 39 wherein one of said anchor members are secured to said brace adjacent its said opposite ends.

41. A mine stopping system as set forth in claim 40 wherein each anchor member includes a plate connected to a respective slide member and lying in a plane generally perpendicular to a longitudinal axis of the slide member.

42. A mine stopping system as set forth in claim 41 wherein said king post has opposite ends with one end secured to the central beam and the other end secured to the tension chord.

43. A mine stopping system as set forth in claim 42 wherein each securement member comprises a plurality of spaced apart uprights secured to the central beam and a rib member secured to the uprights with said rib member extending along at least a portion of the length of the central beam and being spaced from the central beam.

44. A mine stopping system as set forth in claim 43 wherein there are two securement members affixed to the central beam above and below the central beam.

45. A high pressure stopping system installed in a mine to at least partially block a mine passage, said stopping system comprising:

a stopping wall extending between opposite side walls of a mine passage; and an elongate brace for reinforcing the stopping wall against deflection, said brace comprising a central beam having a component which extends perpendicular to the stopping wall to resist lateral forces exerted against the stopping wall by air pressure.

46. A high pressure stopping system as set forth in claim 45 further comprising at least one movable member engaging the central beam to provide relative movement therebetween whereby said brace has a variable length.

47. A high pressure stopping system as set forth in claim 46 wherein the central beam has a rectangular cross section, said component including sides of the beam extending perpendicular to the stopping wall.

48. A high pressure stopping system as set forth in claim 45 wherein the brace includes an anchor member at an end of the brace engaging one of said side walls, the brace being generally horizontally disposed and extending between the side walls of the mine passage.

49. A brace for reinforcing a stopping wall in a mine against deflection, said brace comprising:

a tubular central beam, at least one telescoping slide member telescopically engaging the central beam to provide relative movement therebetween whereby said brace has a variable length, anchor members at opposite ends of the brace adapted to be secured to side walls of the mine, and friction lock means for locking the telescoping slide member in position with respect to the central beam, said friction lock means being adapted to permit telescoping of the telescoping member relative to the central beam in the event of movement of the side walls of the mine.

50. A brace as set forth in claim 49 further comprising a rib member fixed to the central beam for securing the brace to the stopping wall.

51. A brace as set forth in claim 49 wherein the central beam has a rectangular cross section.

52. A brace installed in a mine for reinforcing a stopping wall against deflection, said brace comprising:

a central beam, and at least one slide member slidably engaging the central beam to provide relative movement therebetween whereby said brace has a variable length, each of said beam and slide member being mounted on the stopping wall so that a component of the beam extends perpendicular to the stopping wall to resist lateral forces exerted against the stopping wall by air pressure.

53. A brace as set forth in claim 52 further comprising anchor members at opposite ends of the brace secured to side walls of the mine.

54. A brace as set forth in claim 52 further comprising lock means locking the slide member in position with respect to the central beam.

55. A brace as set forth in claim 52 further comprising a rib member fixed to the central beam for securing the brace to the stopping wall.

56. A brace as set forth in claim 52 wherein the central beam has a rectangular cross section, said component including sides of the beam extending perpendicular to the stopping wall.

* * * * *